US008103155B2

(12) United States Patent
Dannenberg et al.

(10) Patent No.: US 8,103,155 B2
(45) Date of Patent: Jan. 24, 2012

(54) MANUALLY ADJUSTABLE HAIR DRYER MOUNT FOR USE WITH A HAND-HELD HAIR DRYER

(75) Inventors: Jeff Dannenberg, Fort Lauderdale, FL (US); William J Weiss, Deerfield Beach, FL (US); Carl J Regan, Jr., Deerfield Beach, FL (US); Manuel Duarte, Deerfield Beach, FL (US); Hendrik A. Theron, Deerfield Beach, FL (US); Stephen J. King, Deerfield Beach, FL (US)

(73) Assignee: JRD International Enterprises, LLC, Fort Lauderdale, FL (US)

( * ) Notice: Subject to any disclaimer, the term of this patent is extended or adjusted under 35 U.S.C. 154(b) by 193 days.

(21) Appl. No.: 12/533,496

(22) Filed: Jul. 31, 2009

(65) Prior Publication Data

US 2010/0014844 A1 Jan. 21, 2010

Related U.S. Application Data

(63) Continuation-in-part of application No. 29/337,875, filed on Jun. 1, 2009, now abandoned, and a continuation of application No. 12/469,065, filed on May 20, 2009.

(60) Provisional application No. 61/081,475, filed on Jul. 17, 2008.

(51) Int. Cl.
*A47J 27/00* (2006.01)

(52) U.S. Cl. ..... 392/381; 392/379; 392/380

(58) Field of Classification Search ..... 248/274.1, 248/276.1, 278.1; 392/379–385
See application file for complete search history.

(56) References Cited

U.S. PATENT DOCUMENTS

| | | | | |
|---|---|---|---|---|
| 1,419,712 | A | | 6/1922 | Bassette |
| 4,225,106 | A | | 9/1980 | Eplan |
| 4,453,695 | A | | 6/1984 | Sennott et al. |
| 4,461,439 | A | * | 7/1984 | Rose ..... 248/51 |
| 4,691,451 | A | | 9/1987 | Giorgis |
| 4,696,447 | A | | 9/1987 | Strecker |
| 4,712,313 | A | | 12/1987 | Gettleman |
| 4,746,090 | A | | 5/1988 | Hamilton |
| D313,341 | S | | 1/1991 | Gaboriault et al. |
| D314,502 | S | | 2/1991 | Weldin |
| 5,018,697 | A | | 5/1991 | Treanor et al. |
| 5,054,211 | A | | 10/1991 | Shulman |
| 5,268,988 | A | | 12/1993 | Miyamoto et al. |
| 5,350,144 | A | | 9/1994 | Lary |
| 5,592,749 | A | | 1/1997 | Trimmer |
| 5,842,670 | A | | 12/1998 | Nigoghosian |

(Continued)

*Primary Examiner* — Thor Campbell
(74) *Attorney, Agent, or Firm* — Mark D. Bowen, Esq.; Malin Haley DiMaggio Bowen & Lhota, P.A.

(57) ABSTRACT

A hands-free hair dryer mounting apparatus adapted for holding a hair dryer in a universal hair dryer holder assembly is disclosed. The apparatus includes a support bracket that is removably affixed to a wall mounting plate adapted for secure attachment to a wall or other surface. A universal hair dryer holder, adapted for receiving and holding any type, size, or style of handheld hair dryer, projects outward from the bracket. The hair dryer holder is connected to an adjustable arm which contains a vertical pivot connection that allows for manual angular adjustment and affixation of the hair dryer about a generally horizontal pivot axis. The adjustable arm also contains a horizontal pivot connection that allows for manual angular adjustment and affixation of the hair dryer about a generally vertical pivot axis. Angular adjustment in both the vertical and horizontal directions is accomplished by a spring biased interlocking joints.

6 Claims, 13 Drawing Sheets

U.S. PATENT DOCUMENTS

| | | | | |
|---|---|---|---|---|
| 5,881,983 | A | 3/1999 | Hofmann et al. | |
| 5,937,537 | A | 8/1999 | Miller | |
| 5,940,980 | A | 8/1999 | Lee et al. | |
| 5,956,861 | A | 9/1999 | Barnes | |
| 6,061,923 | A | 5/2000 | Case | |
| 6,199,805 | B1 | 3/2001 | Pena | |
| 6,520,467 | B2 | 2/2003 | Thomas et al. | |
| 7,077,370 | B2 | 7/2006 | Lin et al. | |
| D568,708 | S | 5/2008 | Petruccelli | |
| 2007/0290110 | A1* | 12/2007 | West et al. | 248/314 |

* cited by examiner

MANUALLY ADJUSTABLE HAIR DRYER MOUNT FOR USE WITH A HAND-HELD HAIR DRYER

CROSS REFERENCE TO RELATED APPLICATIONS

This application is a continuation-in-part of pending U.S. patent application Ser. No. 29/337,875, filed on Jun. 1, 2009, which is a continuation of U.S. patent application Ser. No. 12/469,065, filed on May 20, 2009, which claims the benefit of provisional Patent Application No. 61/081,475, filed on Jul. 17, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to apparatus for use with hand-held hair dryers, and more particularly to a hair dryer wall mounting apparatus having a manually adjustable hair dryer holder that provides the user with a hands free hair drying accessory.

2. Description of Related Art

A hair dryer, also frequently called a blow dryer, is an electromechanical device designed to blow cool or hot air over wet or damp hair, in order to accelerate the evaporation of water particles and dry the hair. When using the hair dryer the user typically holds the hair dryer in one hand and a styling brush or hair spray in the other. By requiring the user to hold the hair dryer this method of use significantly limits the user's range of motion while the limitation of the remaining hand limits the user's hair styling options.

As a result of the limitations and disadvantages presented with the use of a conventional handheld hair dryer, the background art reveals a number of attempts directed to providing mounting systems for handheld hair dryers. For example, U.S. Pat. No. 7,077,370, issued to Lin et al. discloses a hair dryer stand for a handheld hair dryer that includes a base and a holder pivotally mounted to the base. The stand is adapted for mounting on a horizontal or vertical supporting surface and functions to simply hold the hair dyer in place. U.S. Pat. No. 6,199,805, issued to Pena, discloses a self supporting adjustable support stand for a portable hair dryer. The stand includes a base and a telescopically adjustable extension assembly for selective height adjustment, and elongated flexible connection, and a ring shaped holder for holding the hair dryer. U.S. Pat. No. 5,881,983, issued to Hofmann et al., discloses a hair dryer positioning system having a base and a bendable, shape retaining, dryer positioning arm terminating in a dryer cradle member. U.S. Pat. No. 6,061,923, issued to Case, discloses a hair dryer holder for holding a hair dryer having a base and an adjustably extendable and retractable extension member attached to the base. The extension member terminates in a holding bracket comprising a generally horizontally disposed U-shaped member having a flexible strap extending across the open end thereof to hold the hair dryer with the aid of hook and loop fastening material. The device disclosed by Case, functions to hold the hair dryer in a fixed position, and thus exemplifies basic hair dryer mount/holder technology. Similarly, U.S. Pat. No. 4,453,695, issued to Sennott et al., discloses a hair dryer mount having a wall bracket, extension arms, and a support that includes a strap which fits around the hair dryer.

Other basic mounts and static hair dryer holders are disclosed in the following U.S. Pat. No. 6,520,467, issued to Holder, for a Hair Dryer Holder; U.S. Pat. No. 4,696,447, issued to Strecker, for a Blow Dryer Holding Device; and U.S. Pat. No. 4,746,090, issued to Hamilton, for a Hair Dryer Holder; Des. 313,341, issued to Gaboriault et al., for a Hair Dryer Holder. A problem encountered by many of these hair dryer holders of the prior art is that they often overcomplicate the simple task of providing an adjustable mount for a hair dryer. Many of these systems and apparatuses are bulky and take up a lot of space. Those hair dryer holders of the prior art which sit on a base do not place the hair dryer at a desired height for a user. Although, the wall-mounted hair dryer holders of the prior art solve the latter problem, these systems are often bulky and their installation on a wall is complex and permanent. Furthermore, almost all of the hair dryer holders of the prior art are not universally adaptable to all hair dryers. Every hair dryer has different geometric proportions. The hair dryer holders of the prior art may hold some hair dryers but not others, depending on the shape and size of hair dryer handles.

Accordingly, there exists a need for a hair dyer holding apparatus adapted for holding hair dryers of various shapes. Furthermore, there exists the need for a less complex and less bulky wall-mounted hair dryer holder which may be easily removed or adjusted by the user.

BRIEF SUMMARY OF THE INVENTION

The present invention overcomes the limitations and disadvantages present in the art by providing a hands-free, pivotally-adjustable hair dryer mounting apparatus adapted for holding a hair dryer in a universal hair dryer holder assembly. The apparatus includes a wall mountable support bracket that is removably affixed to a wall mounting plate adapted for secure attachment to a wall or other supporting surface. A universal hair dryer holder, adapted for receiving and holding any type, size, or style of handheld hair dryer, projects outward from the support bracket. The hair dryer holder is connected to an adjustable arm which contains a pivot connection that allows for manual angular adjustment and affixation of the hair dryer about a generally vertical pivot axis. The adjustable arm also contains an additional pivot connection that allows for manual angular adjustment and affixation of the hair dryer about a generally horizontal pivot axis. Angular adjustment in both the vertical and horizontal directions is accomplished by a toothed-gear arrangement that is spring biased to such that the gear teeth are normally in an engaged configuration. Upon application of a force, the gear teeth temporarily disengage thereby allowing for angular adjustment of the universal hair dryer holder. The back plate of the support bracket further includes a mechanism for easy removal of the apparatus from the wall. Finally, in order to prevent unwanted disengagement from the wall, a key is slidingly disposed within the support bracket which locks the bracket to the wall mounting plate.

Accordingly, it is an object of the present invention to provide an improved hands-free holding apparatus for hand-held hair dryers.

Another object of the present invention is to provide such an apparatus adapted with a universal hair dryer mount assembly.

Still another object of the present invention is to provide such an apparatus that is easily installed and removed from a wall.

Yet another object of the present invention is to provide such an apparatus that is relatively uncomplicated and ergonomic.

These and other objects are met by the present invention which will become more apparent from the accompanying drawing and the following detailed description of the drawings and preferred embodiments.

DETAILED DESCRIPTION OF THE INVENTION

Figure 1:
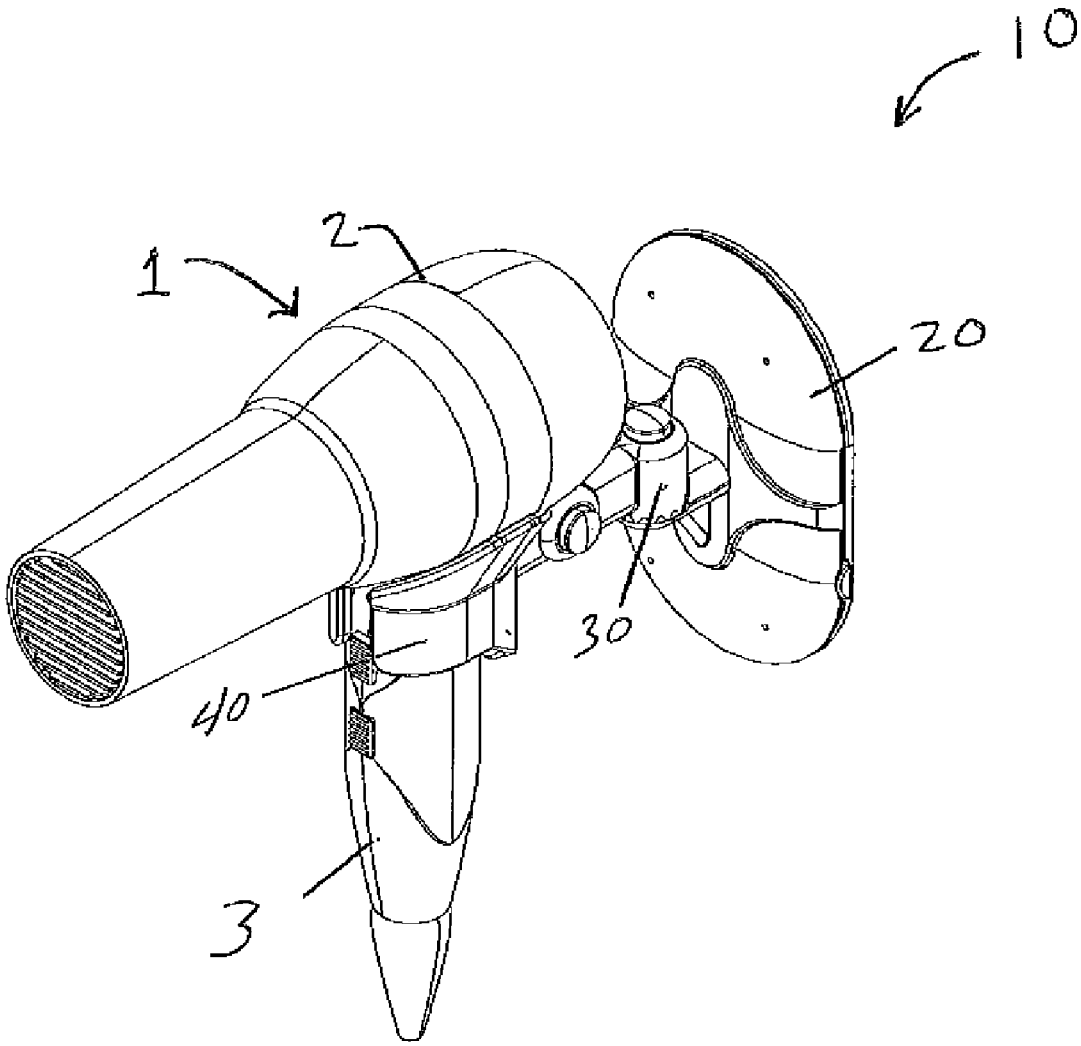
FIG. 1 is a front top perspective view of a hands-free hair dryer mounting apparatus shown holding a hair dryer in accordance with the present invention.

With reference now to the drawings, FIGS. 1-13 depict a hands-free hair dryer mounting apparatus, generally referenced as 10, adapted for holding a hair dryer, generally referenced as 1, in an adjustable universal hair dryer holder assembly in accordance with the present invention. Hair dryer 1 includes a main body 2 and a handle 3. Apparatus 10 generally includes a wall mountable support bracket 20 and adjustable arm 30 projecting from bracket 20 and terminating in a universal hair dryer holder 40. Holder 40 preferably comprises a generally Y-shaped structure that is capable of receiving virtually any configuration of hand-held hair dryer therein without the use of straps or clamps. The present invention thus provides a wall mountable apparatus that allows for hands free use of virtually any conventional hair dryer.

Figure 2:
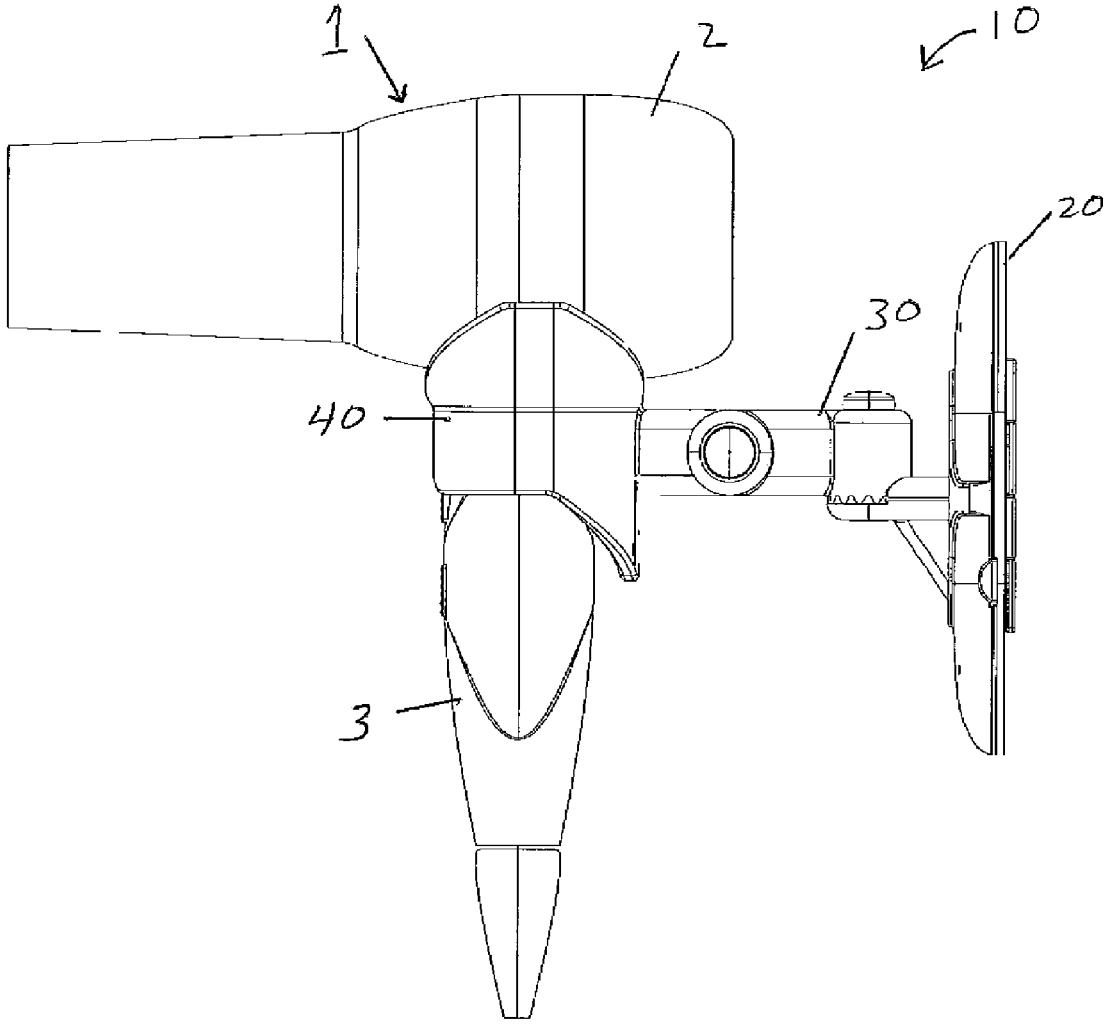
FIG. 2 is a left side view thereof.
Figure 3:
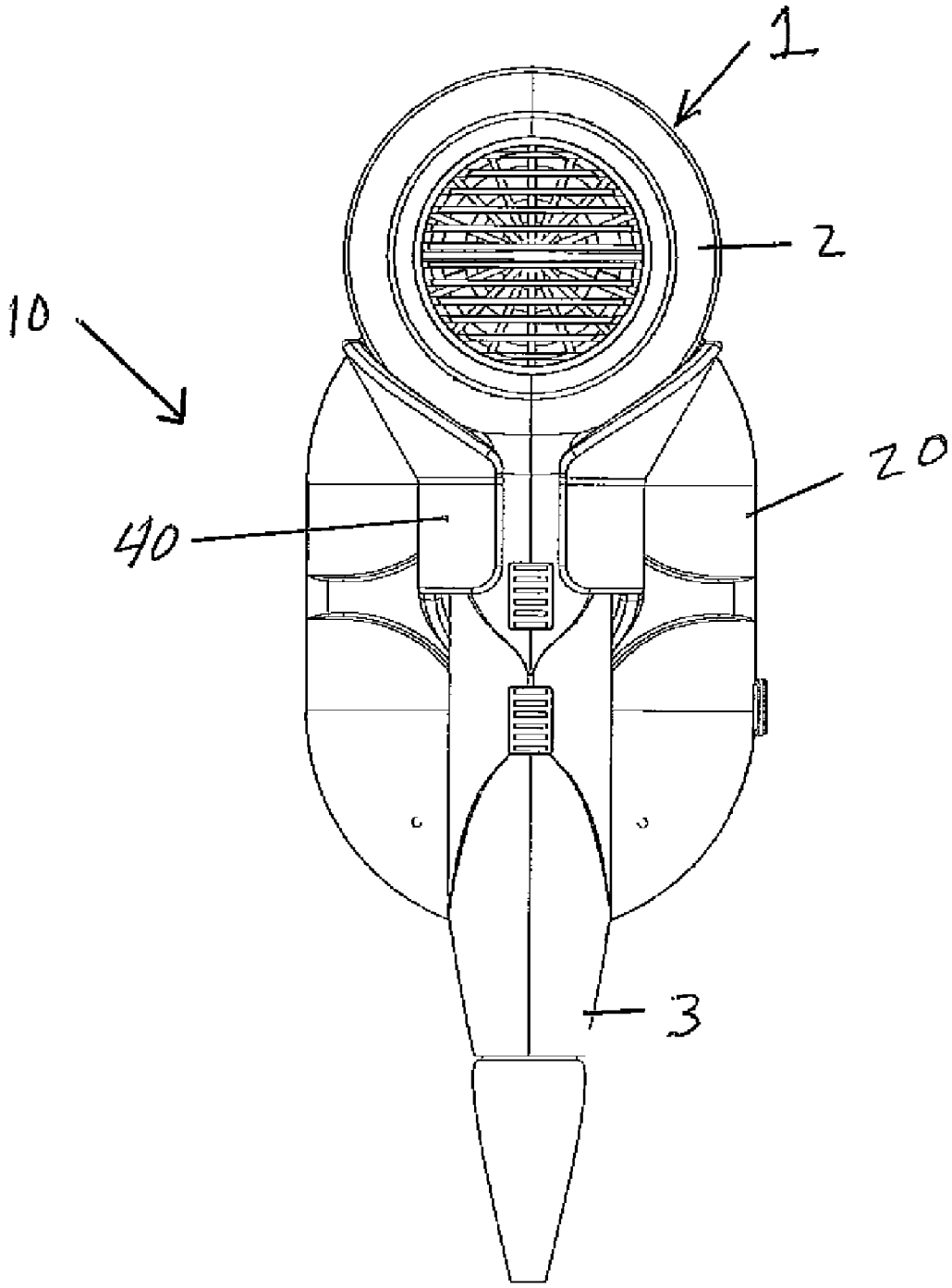
FIG. 3 is a front view thereof.
Figure 4:
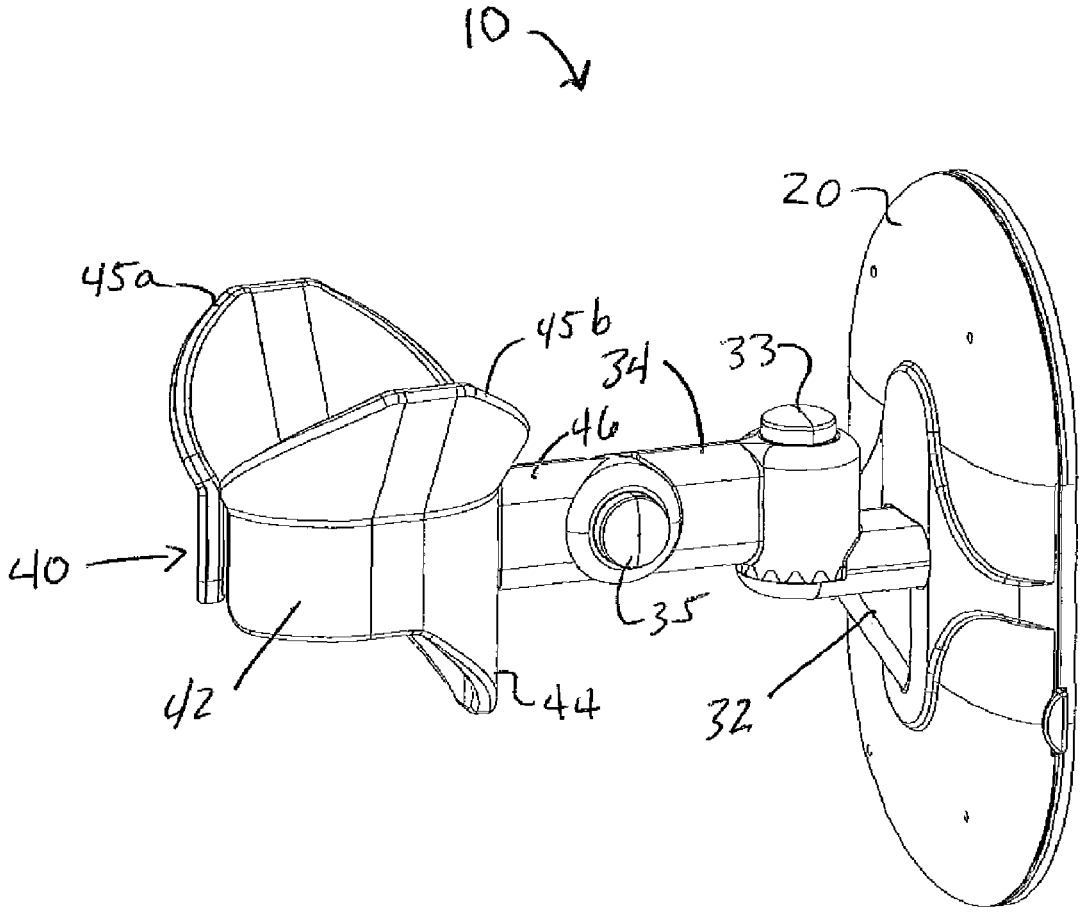
FIG. 4 is a top side perspective view of the hands-free hair dryer mounting apparatus.
Figure 5:
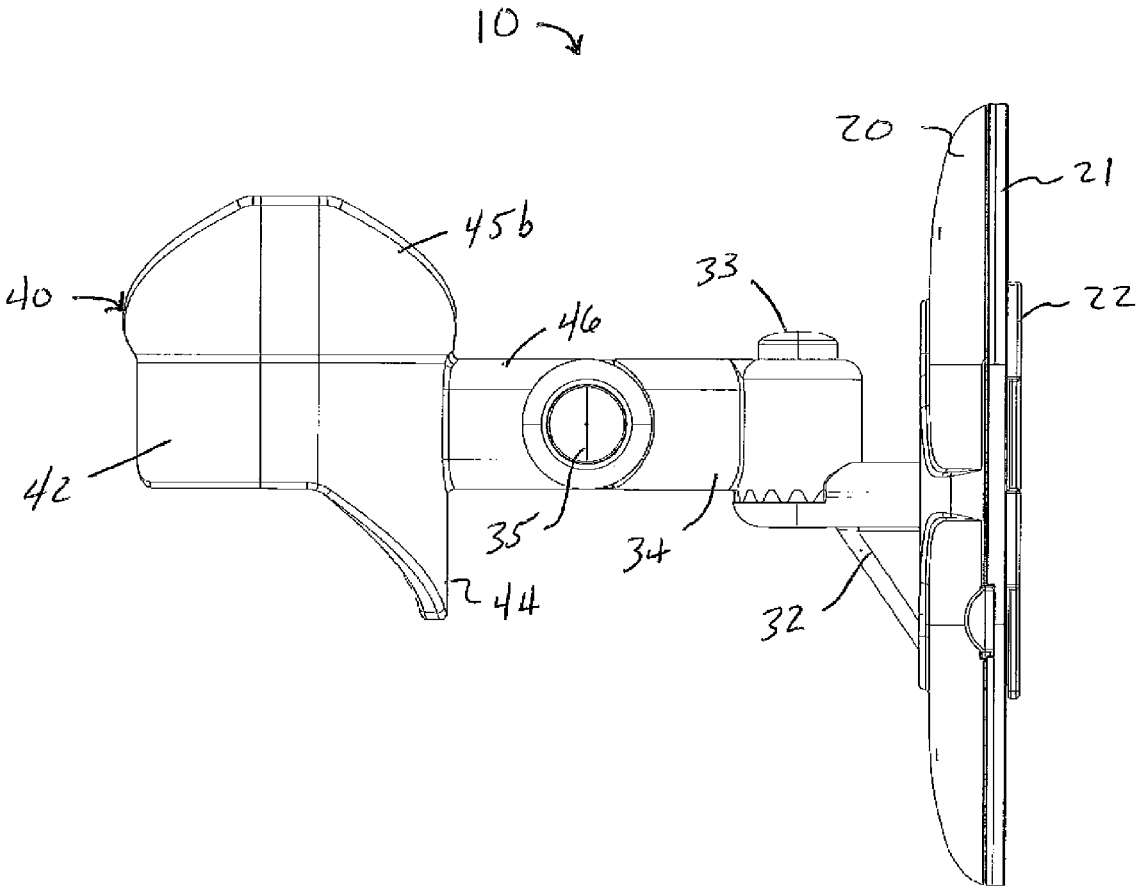
FIG. 5 is a left side view thereof.
Figure 6:
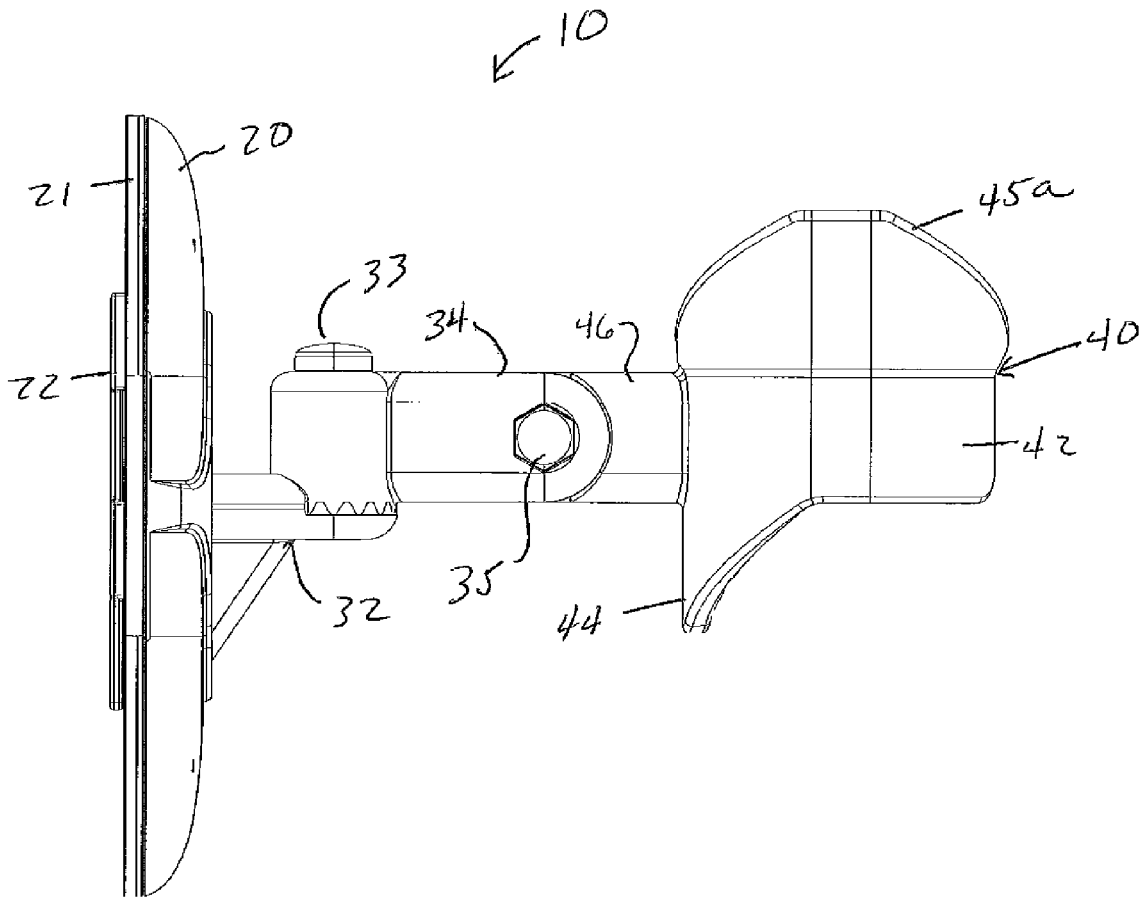
FIG. 6 is a right side view thereof.
Figure 7:
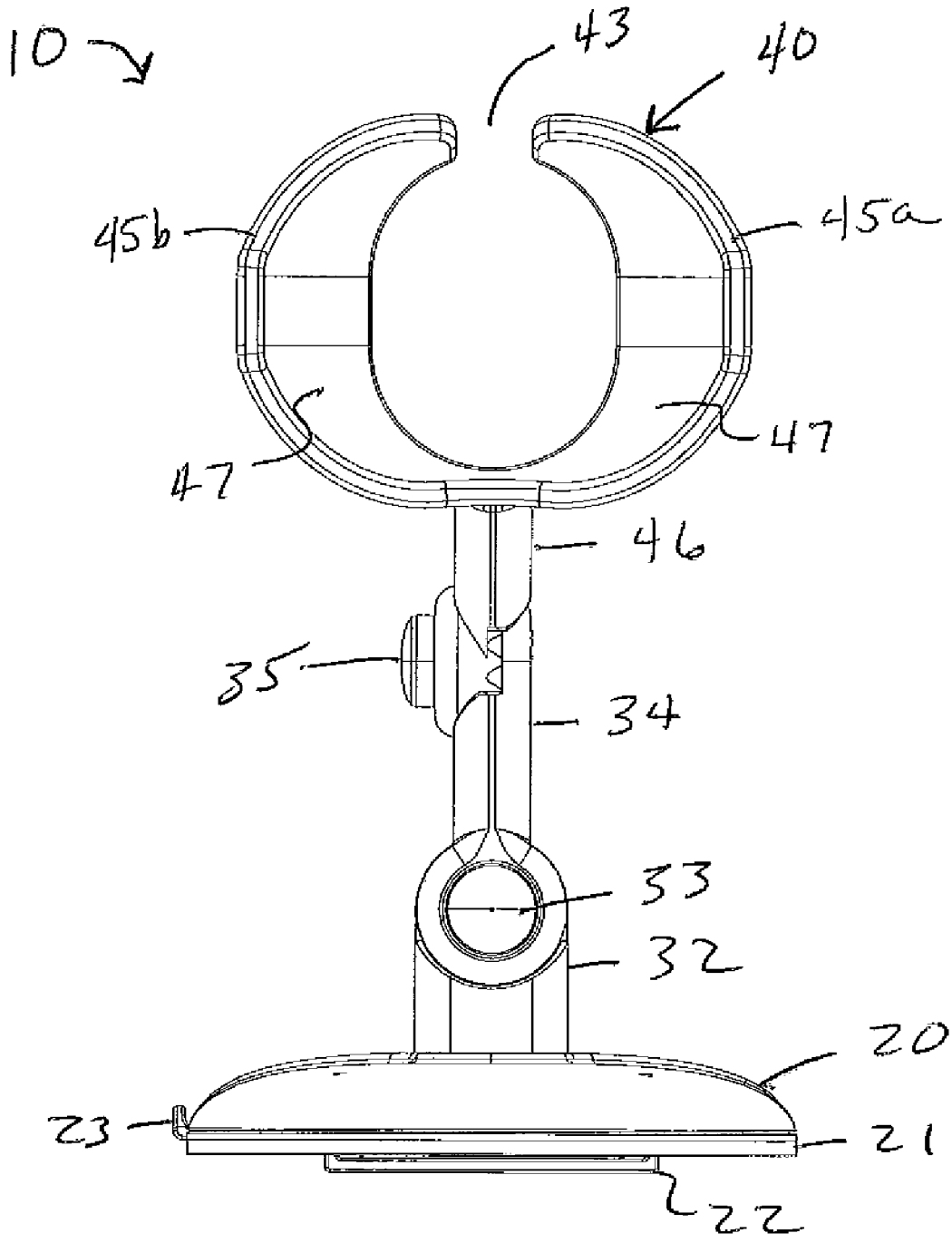
FIG. 7 is a top view thereof.
Figure 8:
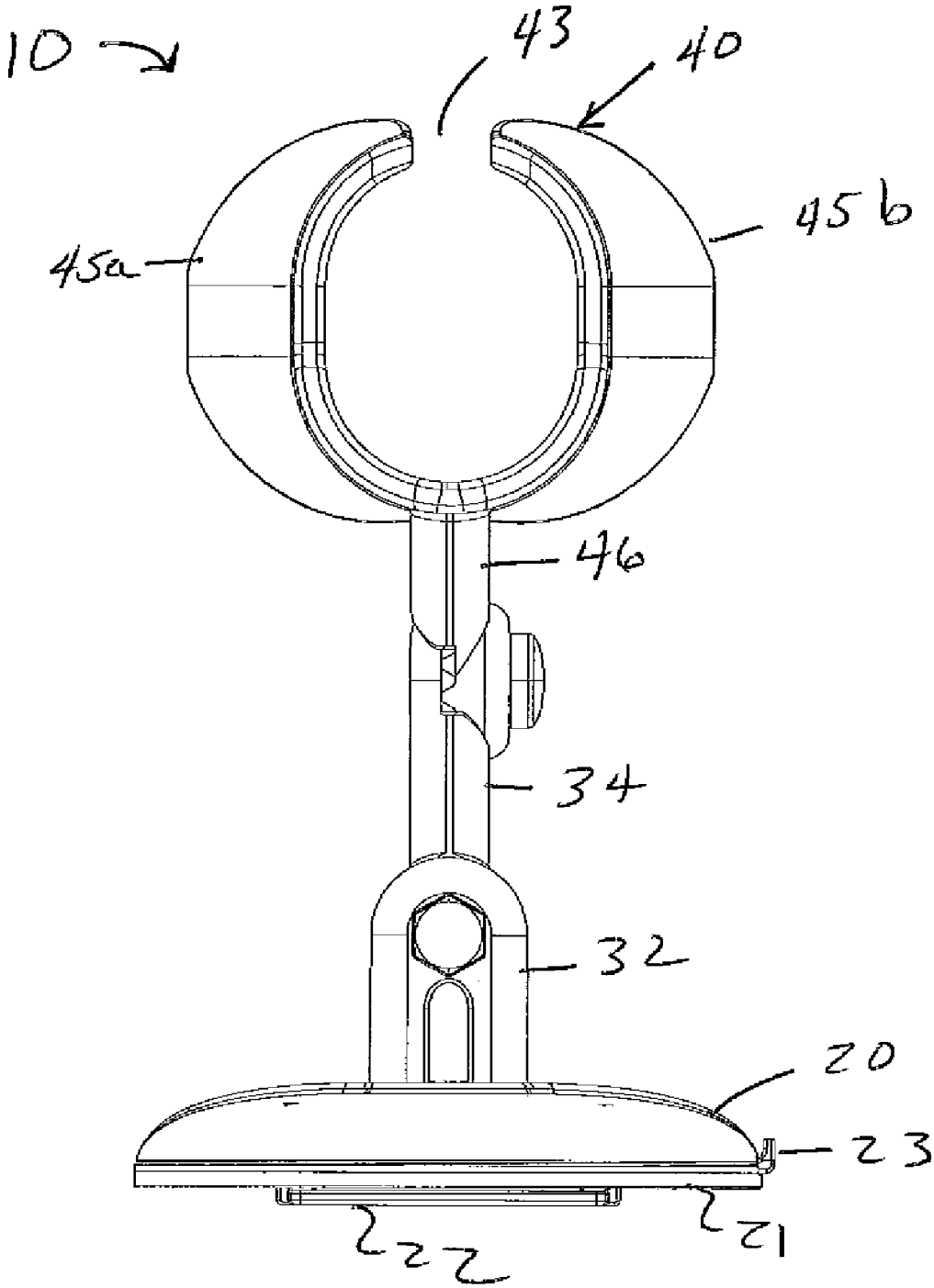
FIG. 8 is a bottom view thereof.
Figure 9:
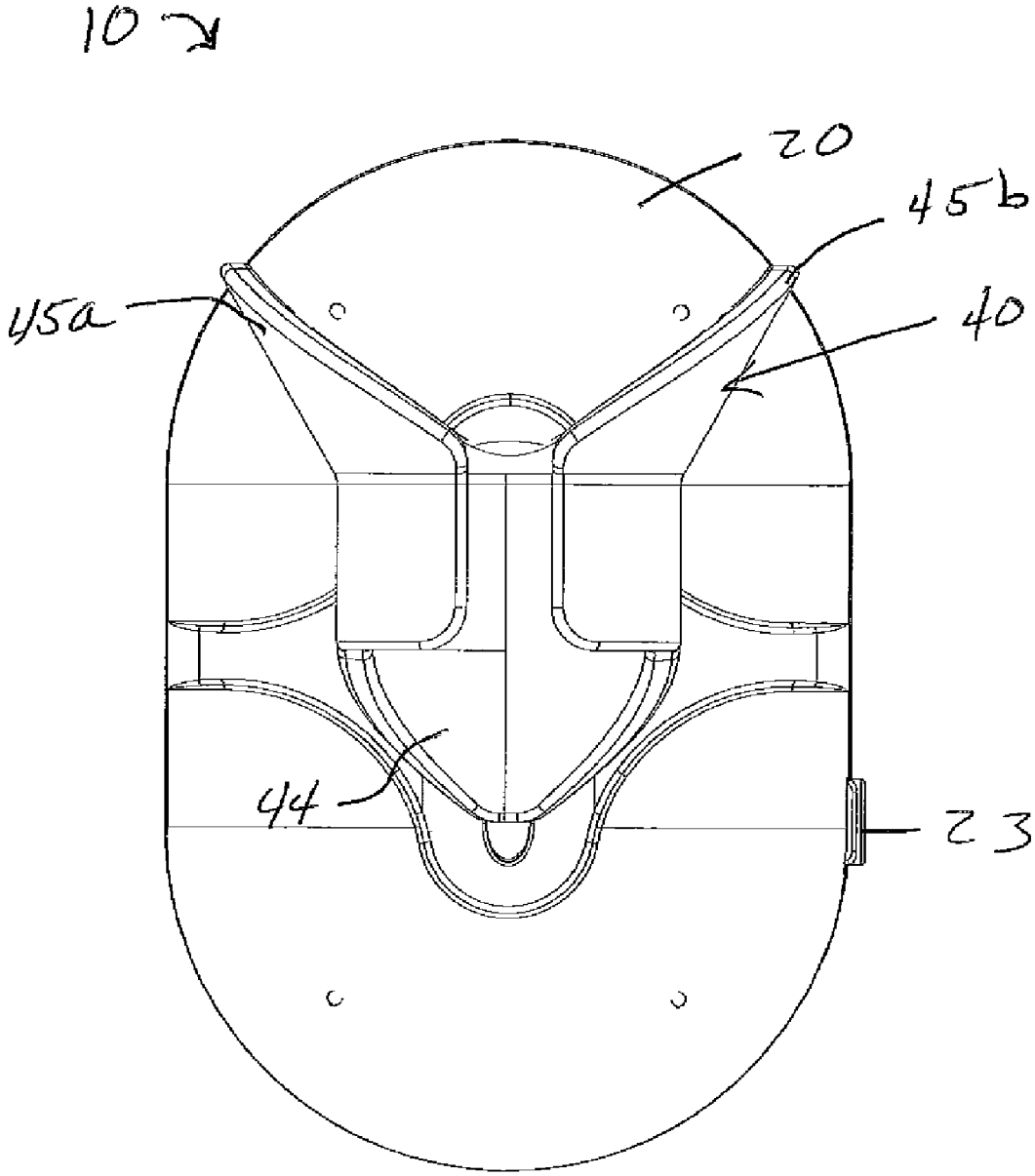
FIG. 9 is a front view thereof.
Figure 10:
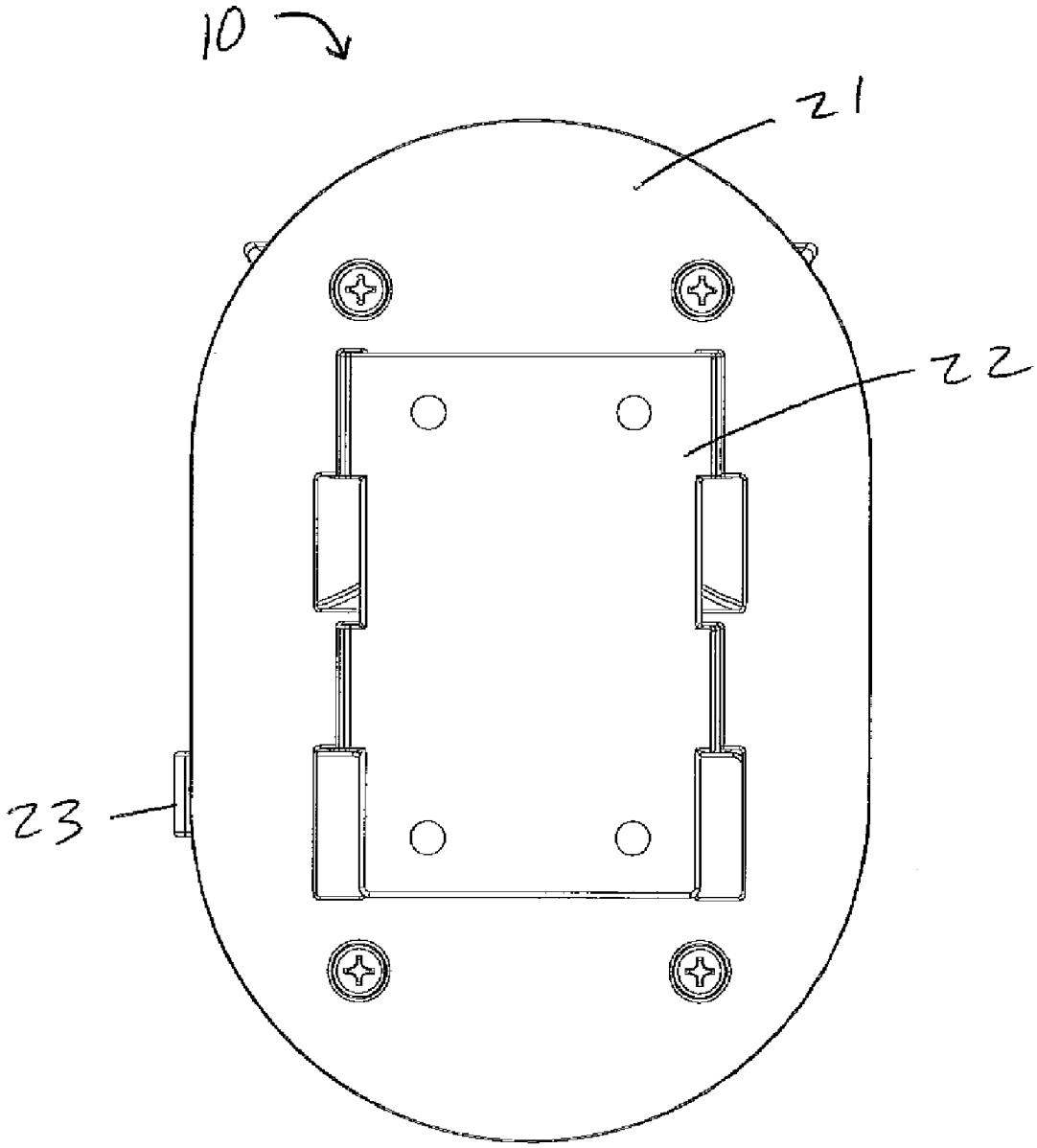
FIG. 10 is a rear view thereof.
Figure 11:
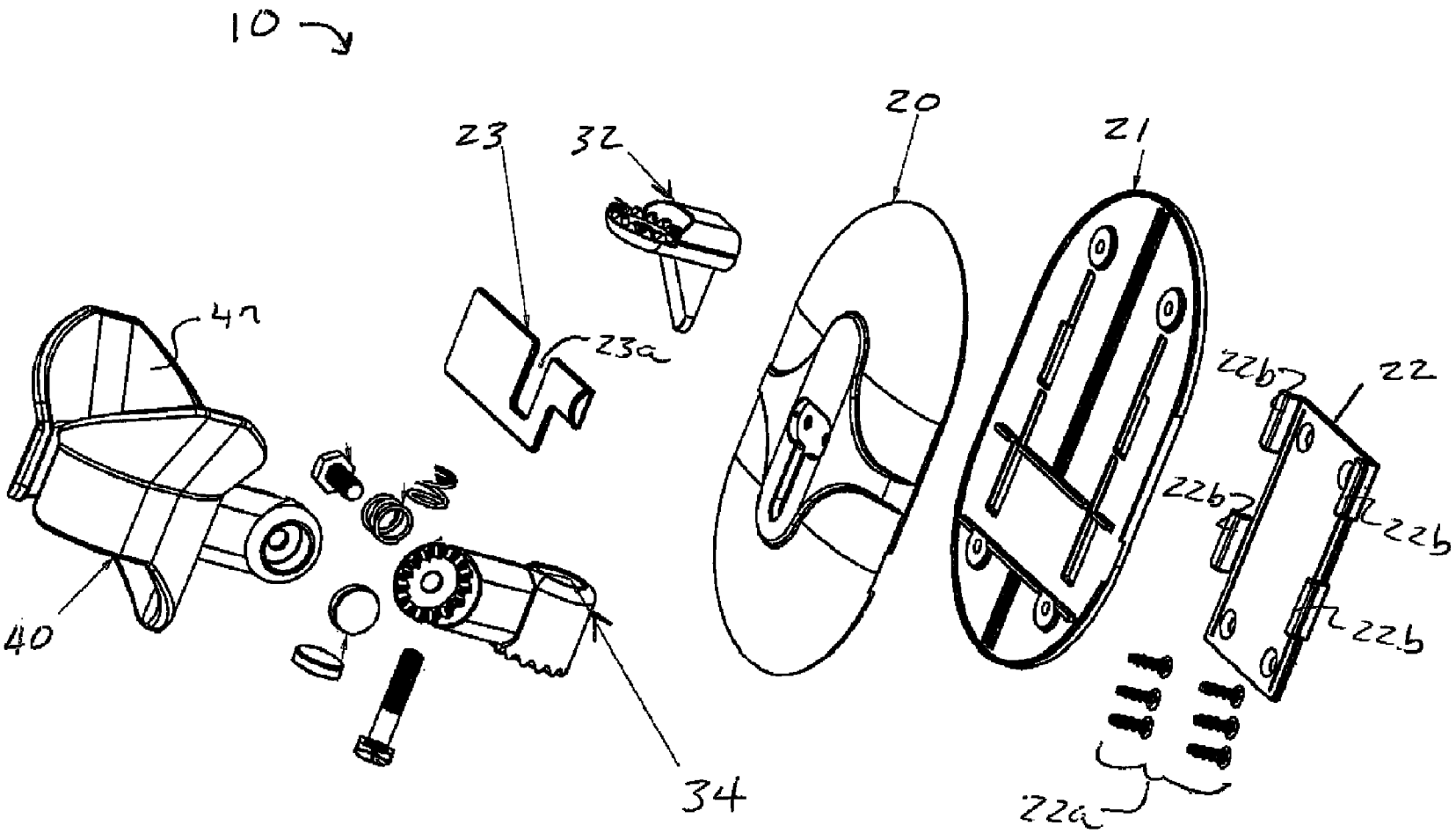
FIG. 11 is an exploded perspective view thereof.
Figure 12:
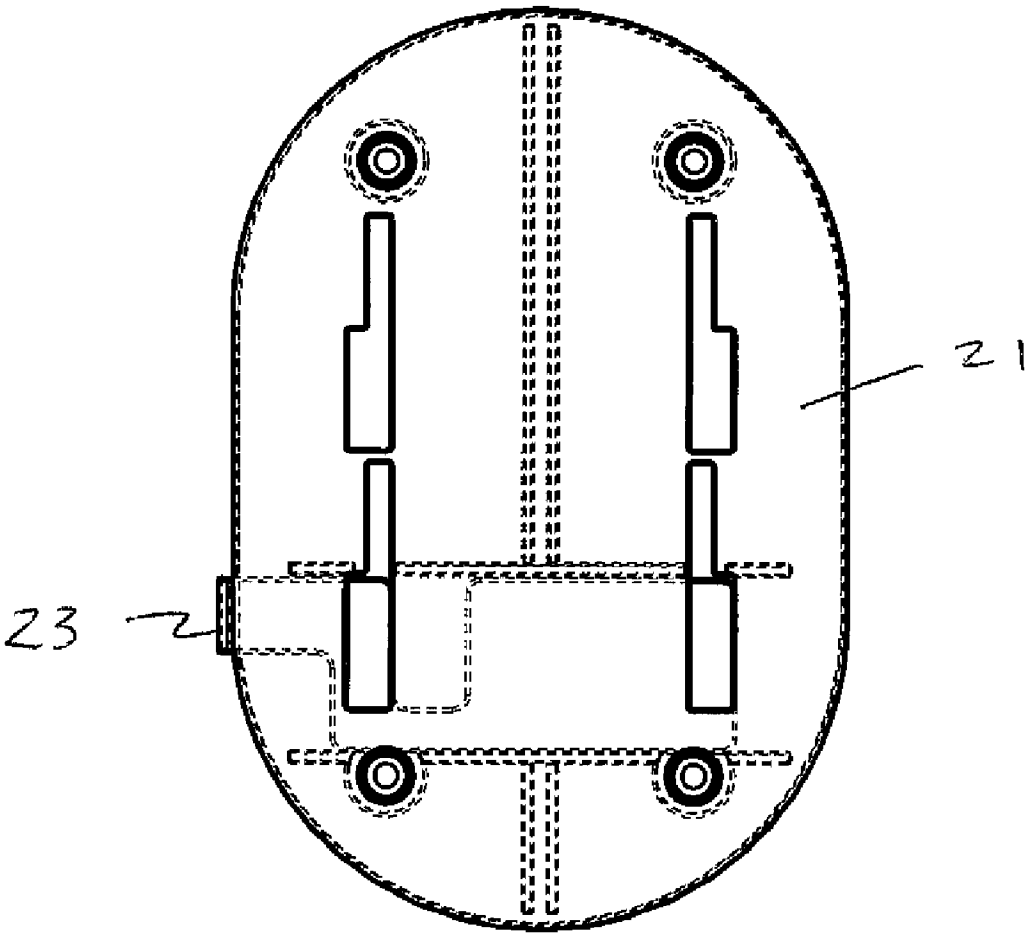
FIG. 12 illustrates use of the locking key to achieve fixed engagement of the back plate with the mounting plate with the slidable locking key in the first position wherein key is substantially inserted within the support bracket whereby said key prevents relative movement between said support racket and said mounting plate.
Figure 13:
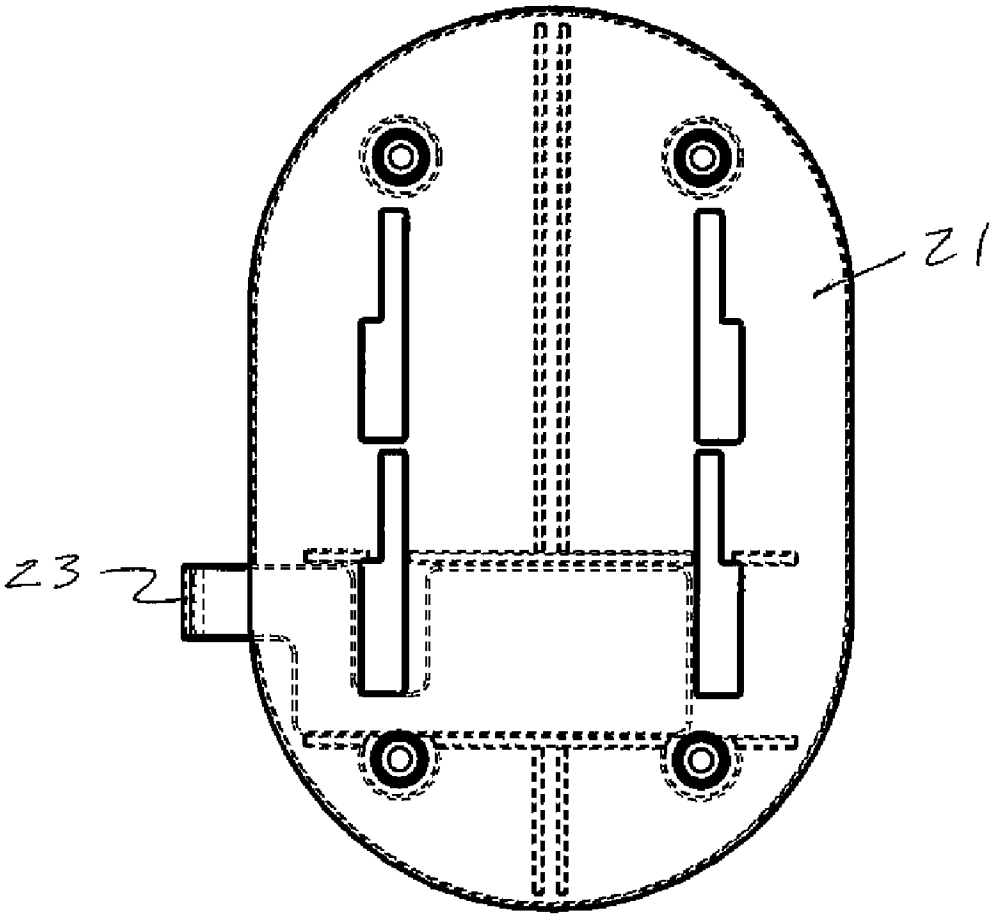
FIG. 13 illustrates use of the locking key to permit movement and disengagement of the back plate from the mounting plate with the slidable key is a second position wherein key projects generally outward from said support bracket whereby relative movement between said support bracket and mounting plate is permitted.

FIGS. 1-3 depict various views of a hair dryer mounting apparatus 10 with a hair dryer 1 operatively mounted thereto, FIGS. 4-10 depict apparatus 10 without the hair dryer, and FIG. 11 provides an exploded perspective view of apparatus 10. Apparatus 10 apparatus includes a wall mountable support bracket 20 that provides a platform for containing and/or connection of the remaining functional components. Support bracket 20 is preferably fabricated from plastic or any other suitable material, and includes a back plate 21 adapted for removable engagement with a mounting plate 22 adapted that is preferably affixed to a wall or other supporting surface via fasteners, generally referenced as 22*a*. Mounting plate 22 further includes a plurality of projecting tabs, referenced as 22*b* that project outward from plate 22. Back plate 21 is adapted for slidable engagement with bracket 22, and a key 23 is slidingly disposed inside a hollow slot inside support bracket 20 to stop further relative movement of back plate 21 relative to bracket 22 in the vertically downward direction. As best seen in FIG. 11, key 23 is generally flat and contains a slot 23*a* which allows the back plate 21 to be moved upward when the key is in its unlocked position. As best illustrated in FIGS. 12 and 13, key 23 is slidably configurable from a first position wherein key 23 is substantially inserted within support bracket 20 (FIG. 12) in a configuration wherein relative movement between back plate 21 and bracket 22 is prevented, to a second configuration wherein key 23 is moved outward from support bracket 20 (FIG. 13) so as to enable relative movement between back plate 21 and bracket 22 thereby allowing support bracket 20 to be removed from mounting plate 22. The key 23 may be simply moved horizontally within the hollow slot thereby allowing apparatus 10 to be disengaged from mounting plate 22. In an alternate embodiment, apparatus 10 further includes a picture frame (not shown) designed to slidingly engage bracket 22 such that the bracket may be concealed. This feature is considered a significant advancement in the art as it allows for the quick and easy removal of the housing and concealment of the mounting bracket. Such a feature is considered highly desirable, particularly in upscale residences. The picture frame (not shown) will preferably include a back portion adapted for mounting engagement with back plate 21 in a manner similar to that disclosed herein, or any other suitable means for engagement.

An angularly adjustable arm assembly, generally referenced as 30, projects outward from bracket 20 and is connected to a universal hair dryer holder 40. Arm 30 includes first and second arm components or members, referenced as 32 and 34, which combine to form an arm assembly having two pivot joint connections, generally referenced as 33 and 35, such that arm assembly 30 is preferably configurable about a vertical pivot axis and a horizontal pivot axis. The first arm component 32 is fastened at its proximal end to support bracket 20, and includes a distal end adapted for connection to second arm component 34 to form a horizontally pivotal joint 33 that allows for relative movement between first and second arm components above a generally vertical pivot axis. The distal end of first component 32 and the proximal end of second component 34 each include an intermeshing gear structure, such as a crown gear, having generally vertically disposed teeth to allow for selective angular fixation about a vertical pivot axis formed between first component 32 and second component 34. Similarly, second arm component 34 includes a distal end adapted for connection to hair dryer holder 40 to form a vertically pivotal joint 35 to permit relative adjustment of holder 40 about a generally horizontal pivot axis. The distal end of second component 34 and the proximal end of holder 40 each include an intermeshing gear structure, such as a crown gear, having generally horizontally disposed interlocking teeth to allow for selective angular fixation about a horizontal pivot axis. While intermeshing gear structures are disclosed herein to facilitate selective adjustment and positioning of various components, the present invention contemplates any suitable adjustment structure that preferably is responsive to one-handed manipulation. In a preferred embodiment, the pivot connections are spring biased such that the teeth are normally in an engaged/interlocking configuration. Upon application of an adjusting force, a spring-biased mechanism allows one gear to move relative to the other by temporarily disengaging the opposing teeth from each other. This feature allow for simple angular horizontal adjustment so that the apparatus may be quickly adapted for use by both tall and short individuals, or to accommodate use by a single individual in different positions e.g. standing or sitting. The fasteners, springs, and associated hardware for completing the spring biased mechanism are illustrated in FIG. 11.

Universal hair dryer holder 40 is generally Y-shaped for receiving and holding any type, size, or style of handheld hair dryer without the aid of additional straps or fastening apparatus. As noted above hair dryer holder 40 is connected to a second arm component 34 of adjustable arm 30 via pivot joint 35 that allows for manual angular adjustment and affixation of the hair dryer about a generally horizontal pivot axis. A significant aspect of hair dryer holder 40 involves its versatility, namely the ability to be used with a wide variety of makes and models of hair dryers without requiring adjustment. More particularly, hair dryer holder 40 is generally Y-shaped when viewed from the front, and includes partially cylindrical main body 42 wherein the distal end defines a generally vertical opening 43 and the proximal end includes a downwardly projecting wall 44 and a V-shaped top portion. V-shaped top portion 45 formed by upwardly and outwardly flared sides, referenced as 45*a* and 45*b* respectively, which function to cradle the main body 2 of hair dryer 1. In a preferred embodiment, top portion 45, and particularly the upper surfaces of flared sides 45*a* and 45*b*, is fabricated from (or includes) a resilient layer or a resilient upper surface, generally referenced as 47, that functions as an anti-slip surface for maintaining the hair dryer 1 in place while further functioning to reduce the transmission of hair dryer generated vibration to apparatus 10 and the supporting wall. An attachment arm 46 projects rearward from the distal end of main body 42 and is adapted for mating engagement with the distal end of the second arm component 34 of the adjustable arm 30. Hair dryer holder 40 receives a hair dryer handle within main body 42, while opening 43 allows the hair dryer electrical cord to pass through. The V-shaped top portion 45, and particularly flared sides 45*a* and 45*b*, defines a downwardly converging structure that functions to cradle the hair dryer main body and prevent sideways tipping. This feature is particularly important to provide lateral stability when the holder 40 is moved via the horizontal and vertical pivot points 36 and 38. The downwardly projecting wall 44 functions as a stop that engages the hair dryer handle and prevents the hair dryer from tipping forward and out of the holder 40. As should now be apparent the V-shape is capable of receiving and cradling hair dryers having virtually any size body.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A hair dryer mounting apparatus for attachment to a generally vertical supporting surface for holding a hair dryer, said apparatus comprising:

a wall mounting plate for attachment to a generally vertical supporting surface;

a support bracket removably connectable to said wall mounting plate;

an adjustable arm including a first arm member affixed to said support bracket and a second arm member connected to said first arm member by a pivot joint configured to allow for selective angular adjustment of said second arm member relative to said first arm member about a generally vertical pivot axis;

a hair dryer holder connected to second arm member by a pivot joint configured to allow for selective pivotal movement of said hair dryer holder about a generally horizontal pivot axis; and said hair dryer holder including a semi-cylindrical wall having a distal end defining a generally slotted opening, and the proximal end including a downwardly projecting wall portion, and a generally V-shaped top portion formed by upwardly and outwardly flared sides;

said connection between said first arm member and said second arm member comprises a pivotal connection spring biased to a fixed configuration, whereby manual angular adjustment is accomplished by application of a force sufficient to cause said pivotal connection to disengage thereby permitting angular adjustment of said second arm member relative to said first arm member about said generally vertical pivot axis; and said connection between said second arm member and said hair dryer holder comprises a pivotal connection spring biased to a fixed configuration, whereby manual angular adjustment is accomplished by application of a force sufficient to cause said pivotal connection to disengage thereby permitting angular adjustment of said hair dryer holder relative to said second arm member about said generally horizontal pivot axis.

2. A hair dryer mounting apparatus according to claim 1, further comprising a key in sliding engagement with said support bracket, said key movable between a first position said key is substantially inserted within support bracket in a configuration wherein relative movement between said support bracket and said wall mounting plate is prevented, and a second configuration wherein said key projects outward from said support bracket so as to enable relative movement between said support bracket and said mounting plate.

3. A hair dryer mounting apparatus according to claim 1, wherein:

said connection between said first arm member and said second arm member comprises intermeshing gears spring biased to said fixed configuration; and said connection between said second arm member and said hair dryer holder comprises intermeshing gears spring biased to said fixed configuration.

4. A hair dryer mounting apparatus according to claim 1 wherein said hair dryer holder V-shaped top portion includes generally upwardly disposed resilient surfaces.

5. A hair dryer mounting apparatus for attachment to a supporting surface for holding a hand-held hair dryer, said apparatus comprising:

a mounting plate adapted for affixation to a supporting surface, said mounting plate including a plurality of projecting tabs;

a support bracket removably connectable to said mounting plate via a plurality of slots defined within said support plate and configured to removably receive said tabs;

said support bracket movable from a first configuration wherein said support bracket is in supported engagement with said mounting plate and a second configuration wherein said support bracket may be disengaged from said mounting plate;

a locking key slidingly disposed relative to said support bracket, said key slidably configurable from a first position wherein key is substantially inserted within said support bracket whereby said key prevents relative movement between said support racket and said mounting plate, to a second position wherein key projects generally outward from said support bracket whereby relative movement between said support bracket and mounting plate is permitted such that said support bracket may be moved between said first and second configurations;

an arm assembly projecting from said support bracket, said arm assembly including a first and second arm members;

said first arm member having a proximal end affixed to said support bracket and a distal end;

said second arm member having a proximal end and a distal end, said proximal end pivotally connected to the distal end of said first arm member to allow for selective pivotal adjustment of said second arm member relative to said first arm member about a generally vertical pivot axis;

a hair dryer holder connected to the distal end of said second arm member by a pivot joint that allows for selective pivotal adjustment of said hair dryer holder relative to said second arm member about a generally horizontal pivot axis said hair dryer holder including a semi-cylindrical wall having a distal end defining a generally slotted opening, and the proximal end including a downwardly projecting wall portion, and a generally V-shaped top portion formed by upwardly and outwardly flared sides, each of said sides having a generally upward facing surface.

6. A hair dryer mounting apparatus according to claim 5, wherein the upward facing surface of each of said hair dryer holder flared sides is resilient.

* * * * *